US009695998B2

(12) United States Patent
Zeng et al.

(10) Patent No.: US 9,695,998 B2
(45) Date of Patent: Jul. 4, 2017

(54) LIGHTING SYSTEM AND METHOD

(71) Applicant: PHILIPS LIGHTING HOLDING B.V., Eindhoven (NL)

(72) Inventors: Xu Zeng, Eindhoven (NL); Caijie Yan, Eindhoven (NL); Wei Wang, Eindhoven (NL); Xiu Yang, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/308,560

(22) PCT Filed: Apr. 28, 2015

(86) PCT No.: PCT/EP2015/059110
§ 371 (c)(1),
(2) Date: Nov. 2, 2016

(87) PCT Pub. No.: WO2015/169632
PCT Pub. Date: Nov. 12, 2015

(65) Prior Publication Data

US 2017/0051887 A1 Feb. 23, 2017

(30) Foreign Application Priority Data

May 5, 2014 (WO) ..... PCT/CN2014/076817
Jun. 19, 2014 (EP) ..... 14173090

(51) Int. Cl.
*F21S 10/00* (2006.01)
*F21S 6/00* (2006.01)
(Continued)

(52) U.S. Cl.
CPC ..... *F21S 10/00* (2013.01); *F21S 6/004* (2013.01); *F21V 3/00* (2013.01); *F21V 7/00* (2013.01);
(Continued)

(58) Field of Classification Search
CPC .. H05B 37/02; H05B 37/029; H05B 33/0845; F21S 10/00; F21S 48/23; F21S 10/066;
(Continued)

(56) References Cited

U.S. PATENT DOCUMENTS 6,183,100 B1 2/2001 Suckow et al.
6,364,506 B1 4/2002 Gallo
(Continued)

FOREIGN PATENT DOCUMENTS

CN 202972800 U 6/2013
DE 102009030602 A1 1/2011
(Continued)

*Primary Examiner* — Haissa Philogene

(57) ABSTRACT

The invention provides a lighting system for providing illumination on a surface (16), comprising a first array (10) of light sources (13) and a first reflector (12) for forming a first pattern on the surface, and a second array (10) of light sources (13) and a second reflector (12) for forming a second pattern on the surface (16), arranged concentrically around the first pattern. A controller (44) controls the first and second arrays (10) of light sources (13) to apply a cyclic function thereby to define one or more radially propagating rings or partial rings of illumination on the surface (16). This is enables a dynamic ripple lighting effect to be provided on the surface (16).

15 Claims, 11 Drawing Sheets

(51) Int. Cl.

| | |
|---|---|
| ***H05B 33/08*** | (2006.01) |
| ***F21V 3/00*** | (2015.01) |
| ***F21V 23/00*** | (2015.01) |
| *F21V 7/00* | (2006.01) |
| *F21V 23/04* | (2006.01) |
| *F21W 121/00* | (2006.01) |
| *F21Y 103/33* | (2016.01) |
| *F21Y 115/10* | (2016.01) |
| *F21Y 105/18* | (2016.01) |

(52) U.S. Cl.
CPC ..... *F21V 23/005* (2013.01); *H05B 33/0803* (2013.01); *H05B 33/0845* (2013.01); *F21V 7/0008* (2013.01); *F21V 7/0058* (2013.01); *F21V 23/04* (2013.01); *F21W 2121/00* (2013.01); *F21Y 2103/33* (2016.08); *F21Y 2105/18* (2016.08); *F21Y 2115/10* (2016.08)

(58) Field of Classification Search
CPC F21S 48/215; F21S 6/004; F21V 7/00; F21V 7/0025; F21V 7/0058; F21V 7/043; F21Y 2105/10; F21Y 2105/18; F21Y 2115/10
USPC ..... 315/297, 307, 312; 362/35, 493, 800, 362/545, 249.02, 235; 700/11
See application file for complete search history.

(56) References Cited

U.S. PATENT DOCUMENTS

| | | | | |
|---|---|---|---|---|
| 6,433,483 | B1 * | 8/2002 | Michael | A44C 15/0015 315/200 A |
| 7,353,071 | B2 * | 4/2008 | Blackwell | H05B 37/029 700/11 |
| 7,985,004 | B1 | 7/2011 | Schach et al. | |
| 8,033,683 | B2 | 10/2011 | Fields | |
| 8,967,829 | B2 * | 3/2015 | Hata | F21K 9/64 313/46 |
| 2002/0078221 | A1 | 6/2002 | Blackwell et al. | |
| 2007/0002572 | A1 | 1/2007 | Ewig et al. | |
| 2010/0027281 | A1 | 2/2010 | Waters et al. | |
| 2012/0127709 | A1 | 5/2012 | Mrakovich et al. | |
| 2012/0300449 | A1 * | 11/2012 | Fields | F21V 7/0058 362/231 |

FOREIGN PATENT DOCUMENTS

| | | | |
|---|---|---|---|
| EP | 2090820 | A2 | 8/2009 |
| EP | 2690345 | A1 | 1/2014 |
| KR | 1209245 | B1 | 12/2012 |

* cited by examiner

LIGHTING SYSTEM AND METHOD

CROSS-REFERENCE TO PRIOR APPLICATIONS

This application is the U.S. National Phase application under 35 U.S.C. §371 of International Application No. PCT/EP2015/059110, filed on Nov. 12, 2015, which claims the benefit of Chinese Patent Application No. PCT/CN2014/076817, filed on May 5, 2014 and European Patent Application No. 141730903, filed on Jun. 19, 2014. These applications are hereby incorporated by reference herein.

FIELD OF THE INVENTION

The invention relates to lighting systems, in particular for providing an aesthetic illumination pattern to a surface to be illuminated.

BACKGROUND OF THE INVENTION

Compared with traditional light sources such as incandescent light sources, LEDs have many advantages including higher efficacy, longer lifetime, smaller size and faster switching. The smaller size of LEDs means that they can be considered as a point source when designing optics. This makes it easier and more efficient to design precise light distributions to be provided by LED light sources.

The fast switching characteristic of LEDs enables dynamic lighting effects to be created, which are becoming more and more popular both in outdoor and indoor applications.

Optical structures enable various lighting patterns to be designed, which can be provided on a target surface, which may be a flat plane such as a wall or floor, or indeed a curved surface, such as undulating ground. Normally, lighting patterns are fixed and cannot be changed after fabrication of a luminaire molding. Such fixed lighting patterns can be monotonous and uninteresting.

Luminaires are also known which can change the lighting pattern produced by adopting moving elements, but these introduce extra luminaire cost and maintenance cost.

There is therefore a need for a luminaire which provides a dynamic aesthetically interesting output, preferably without the need for mechanically moving components.

SUMMARY OF THE INVENTION

The invention is defined by the claims.

According to the invention, there is provided a lighting system for providing illumination on a surface, comprising:

a first array of light sources;

a first reflector for reflecting the output of the first array of light sources to form a first annular illumination pattern or a portion of a first annular illumination pattern on the surface;

a second array of light sources;

a second reflector for reflecting the output of the second array of light sources to form a second annular illumination pattern or a portion of a second annular illumination pattern on the surface, arranged concentrically around the first annular illumination pattern or the portion of the first annular illumination pattern; and a controller for controlling the first and second arrays of light sources, wherein the controller is adapted to apply a cyclic function to the light source array outputs thereby to define one or more radially propagating rings or partial rings of illumination on the surface.

This lighting system provides concentric full or partial illumination patterns (i.e. rings or bands) on a surface to be illuminated. By controlling the rings in a cyclic manner with propagating rings or partial rings of illumination, a ripple effect can be produced. A high intensity for example represents a large ripple and a low intensity represents calm water. The ripples can be made to be perceived as moving radially outwardly from the lighting system, to mimic ripples from a stone dropped into water. However, if desired, an effect of radially inwardly moving ripples can instead be created. For example, a ring may move radially outwardly then back again. Alternatively the ring or rings may move only radially outwardly in a repeating sequence. The preferred application has radially outwardly propagating rings of illumination.

The annular patterns can be circular (as would be ripples from a stone), but this is not essential. The annular patterns may instead each be any closed polygon or portion thereof, such as a hexagon or a star shape.

The lighting system may be designed to provide only portions of annular patterns, such as 90 degree or 180 degrees portions of an annulus. This is of interest if the lighting system is intended to be placed against a wall, for example, or in a corner. Thus, each illumination pattern may comprise a partial ring of at least 90 degrees of an annulus, for example at least 180 degrees, and optionally a full closed annulus.

Preferably, the lighting system is for mounting on a horizontal surface which is the surface to which illumination is to be provided. This may be a water surface for example of a pond, or a public paved area or a garden space. The surface may be flat, or it may be contoured. The lighting system may instead be used in the home.

The light sources may comprise LEDs. Full advantage can then be taken of the ability of LEDs to create dynamic lighting effects.

The system can comprise at least three arrays of light sources and associated reflector, each for forming a different respective concentric annular illumination pattern or portion of an annular illumination pattern. There may indeed be more arrays, such as 5 or more for example between 5 and 20.

By having a large number of light source arrays, the surface to be illuminated can be divided into many concentric areas to enable a realistic ripple effect.

Each light source array may comprise an annular ring or partial ring of upwardly facing light sources, and each reflector comprises a curved annular or partial annular reflector above the respective light source array, with each light source array extending fully or partially around a shaft at a different position along the shaft.

The shaft for example is mounted upright, so that the lighting system comprises a vertical stack of light source arrays, each with a reflector over the top. The light sources higher up the shaft provide the radially outer annular illumination patterns (i.e. further from the lighting system), and the light sources lower down provide the radially inner annular illumination patterns. This provides a compact arrangement in the form of a vertical standing luminaire. Preferably, the annular illumination patterns (or portions) on the surface do not overlap, and there may also be no significant gap between the annular illumination patterns (or portions) on the surface so that a continuous lighting effect can be obtained.

The concentric illumination patterns may have different radial thickness, which radial thickness increases with radial distance from the lighting system.

This enables a more realistic ripple effect to be simulated, in that a ripple period increases with increasing distance from the central source. The same effect can instead be created by having concentric patterns of the same thickness and instead using control of the lighting to give the effect of different width rings. The inner ripples can then be formed of fewer concentric patterns and the outer ripples can be formed of a larger number of concentric patterns. In this way, if the individual concentric patterns are thin enough, a variety of lighting patterns can be implemented.

Each light source array may comprise a printed circuit board with LEDs mounted thereon.

The lighting system may comprise an outer housing which has a droplet shape.

This provides an aesthetic outer appearance in keeping with the lighting effect.

The controller may be adapted to drive each array of light sources with a sinusoidal intensity function.

This means each annular pattern grows in intensity and then decreases to give a more natural lighting effect than an abrupt on-off function. The sinusoidal functions can overlap for the adjacent annular patterns, to give the impression of a gradual progression of a ripple radially. The sinusoidal function may be continuous, to define a continuous stream of ripples advancing radially. Alternatively, the sinusoidal function may be discontinuous, for example one or more amplitude peaks followed by a zero output. This defines one or more ripples passing radially.

The phase of the sinusoidal intensity function for one annular illumination pattern may be different to the phase of the sinusoidal intensity function for an adjacent annular illumination pattern. The different phases enable the peak intensity to be perceived as progressing radially. There may for example be a phase shift in the same sense between the sinusoidal intensity functions for successive adjacent illumination patterns in a direction away from the lighting system.

By "phase shift in the same sense" means always an increase in phase (positive) or always a decrease in phase (negative). The progressive change in phase gives the effect of a wave of high intensity moving across the annular illumination patterns (i.e. radially).

The amplitude of the sinusoidal intensity function for one illumination pattern may also be different to the amplitude of the sinusoidal intensity function for an adjacent illumination pattern.

The use of different intensities also enables a realistic effect to be obtained, for example with the intensity decreasing with distance to mimic ripples fading out with distance.

The invention also provides a method of providing lighting using a lighting system for providing illumination on a surface, the lighting system comprising a first array of light sources forming a first annular illumination pattern or a portion of a first annular illumination pattern on the surface and a second array of light sources forming a second annular illumination pattern or a portion of a second annular illumination pattern on the surface arranged concentrically around the first annular illumination pattern, wherein the method comprises:

applying a cyclic function to the light source outputs thereby to define one or more radially propagating rings or partial rings of illumination.

The method may involve driving each array of light sources with a sinusoidal intensity function, wherein the phase of the sinusoidal intensity function for one illumination pattern is different to the phase of the sinusoidal intensity function for an adjacent illumination pattern. There may be a phase shift in the same sense between the sinusoidal intensity functions for successive adjacent illumination patterns in a direction away from the lighting system. The method may also comprise driving each array of light sources with a sinusoidal intensity function, wherein the amplitude of the sinusoidal intensity function for one illumination pattern is different to the amplitude of the sinusoidal intensity function for an adjacent illumination pattern such that there is a decrease in amplitude between the sinusoidal intensity functions for successive adjacent illumination patterns in a direction away from the lighting system.

The invention also provides a computer program product stored on a computer readable medium for implementing the control method of the invention when the program is run on a computer.

The invention also provides a medium is provided for storing and comprising the computer program product as described above. The medium can be anything ranging from a volatile memory to a non-volatile memory, such as RAM, PROM, EPROM, a memory stick, or flash drive, or another non-volatile storage such as a hard disk or an optical medium, etc.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting system for providing illumination on a surface, comprising a first array of light sources and a first reflector for forming a first pattern on the surface, and a second array of light sources and a second reflector for forming a second pattern on the surface, arranged concentrically around the first pattern. A controller controls the first and second arrays of light sources to apply a cyclic function thereby to define one or more radially propagating rings or partial rings of illumination on the surface. This enables a dynamic ripple lighting effect to be provided on the surface.

Figure 1:
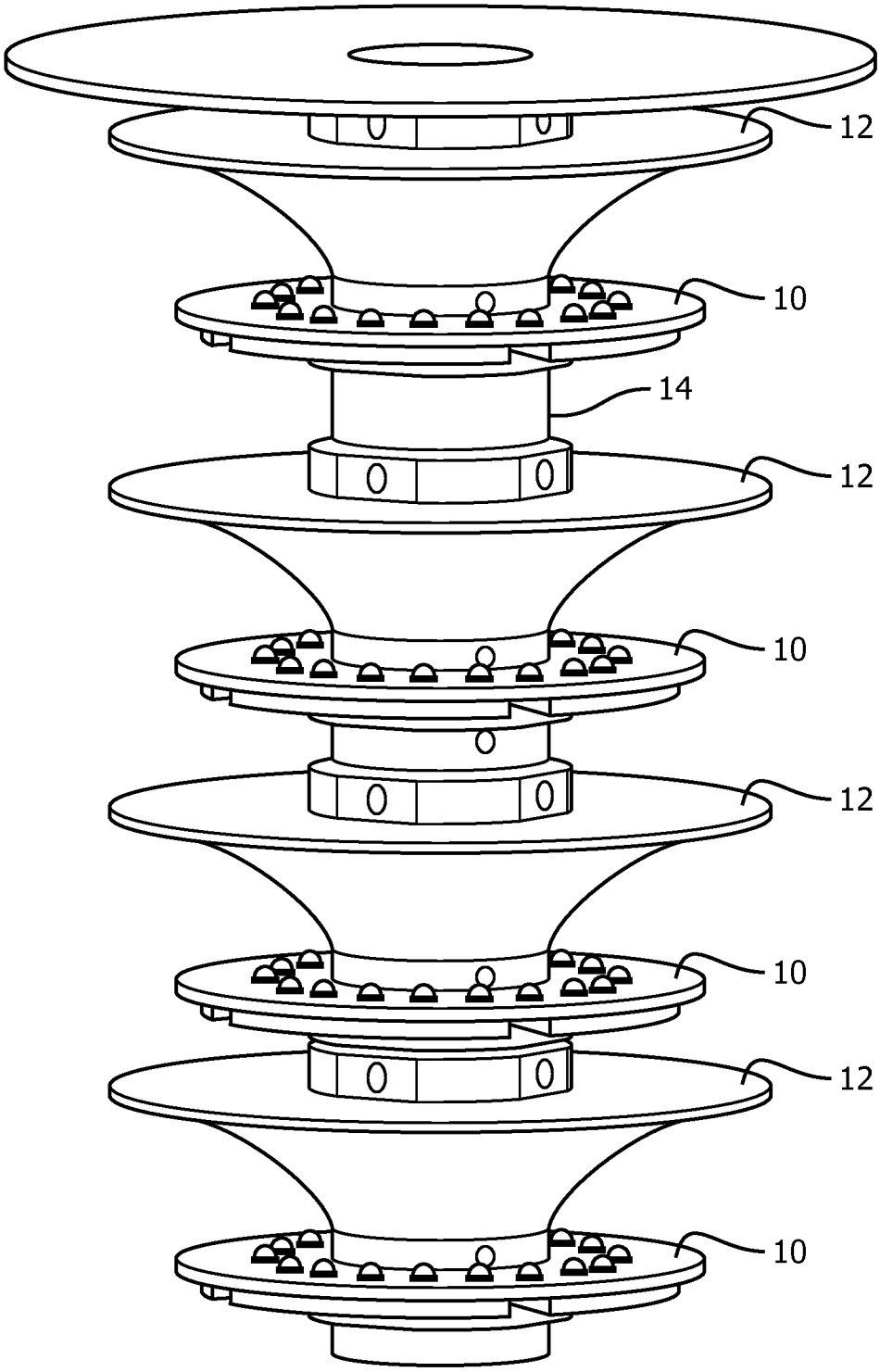
FIG. 1 shows a lighting system.

FIG. 1 shows a first example of lighting system in the form of a luminaire for mounting on a surface to be illuminated. The luminaire comprises a stack of LED arrays 10 each with an associated reflector 12. Each LED array comprises discrete LEDs provided on a printed circuit board. In the example shown, the LED arrays each form a closed circle of LEDs, and the circle surrounds an upright shaft 14. The different LED arrays are all coaxial about the same shaft 14, and at different positions along the shaft.

The LEDs emit light upwardly for reflection by the associated reflector 12 above the LED array. The reflector provides illumination to a surface on which the luminaire is mounted.

Figure 2:
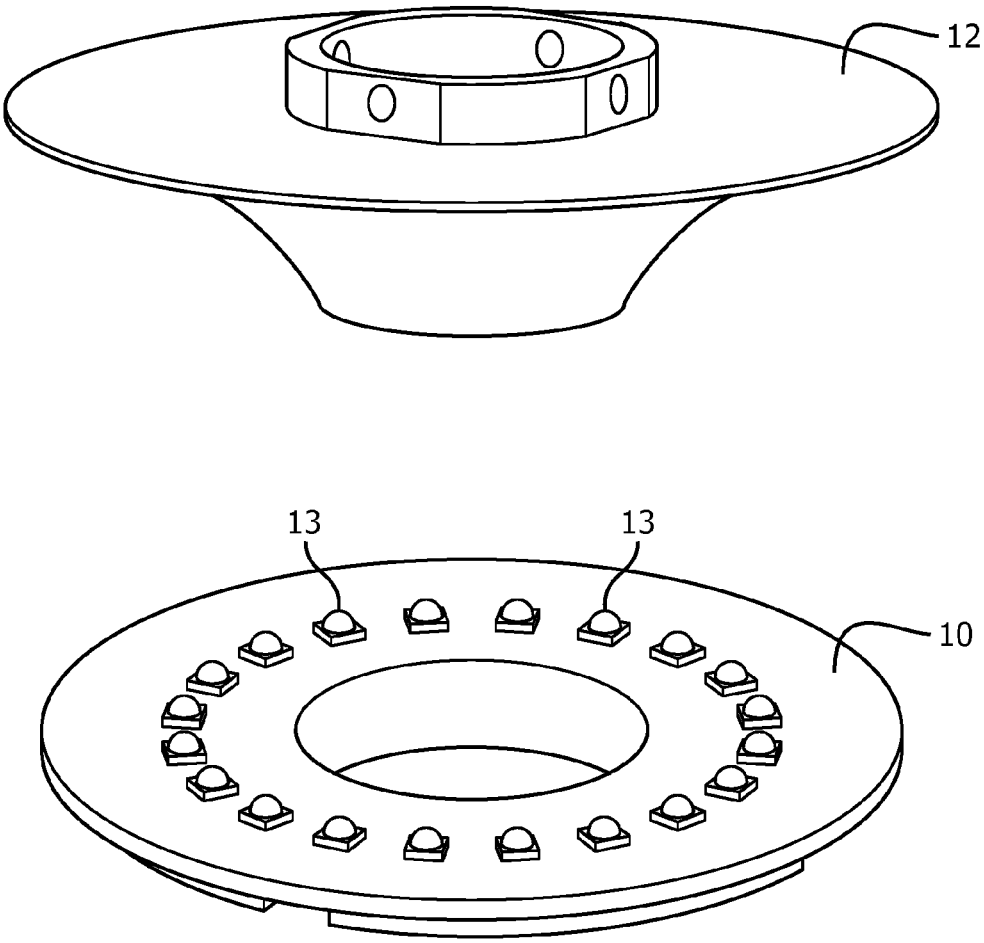
FIG. 2 shows an individual LED array and individual reflector used in the system of FIG. 1.

FIG. 2 shows one LED array 10 and one reflector 12 more clearly. Although a circular loop of LEDs 13 is shown, the LEDs may be arranged as a circle, quadrilateral or other polygon. Furthermore, the LED arrays do not need to surround the shaft, and may instead only define a portion of an annulus. The illumination provided to the surface (on which the luminaire is mounted) by each reflector 12 is thus either an annular illumination pattern or a portion of an annular illumination pattern.

The reflectors 12 can be identical or they may be different. The shape of the reflectors may be rotational symmetric, axisymmetric or unsymmetrical.

The annular illumination patterns provided by the different reflectors are arranged concentrically, with the central axis comprising the axis of the shaft 14. Thus, each reflector contributes one ring (or partial ring) of an overall lighting pattern to the surface. The overall lighting pattern comprises a set of concentric rings (or partial rings). These light pattern rings can be circular, quadrilateral or other polygon, and they derive from the interaction between the shape of the LED array and the shape of the reflector.

A controller is used for controlling the arrays of light sources. The different light source arrays can be controlled independently. All LEDs within one array may be controlled in the same way, but it is also possible for different LEDs within one array to be controlled differently.

By driving different LED arrays, a radially changing pattern can be created on the surface. By driving different LEDs within an array, a rotationally changing pattern can also be created on the surface.

A cyclic function is applied to the light source array outputs thereby to define one or more radially propagating rings or partial rings of illumination on the surface. By controlling the rings in a cyclic manner with propagating rings or partial rings of illumination, a ripple effect can be produced. A high intensity for example represents a large ripple and a low intensity represents calm water. For example, by driving the LED arrays from bottom to top, a light pattern will be created which progresses radially outwardly from the center to outer periphery, and similarly a radially inwardly progressing light pattern can be created by driving the LED arrays in the opposite order.

Figure 3:
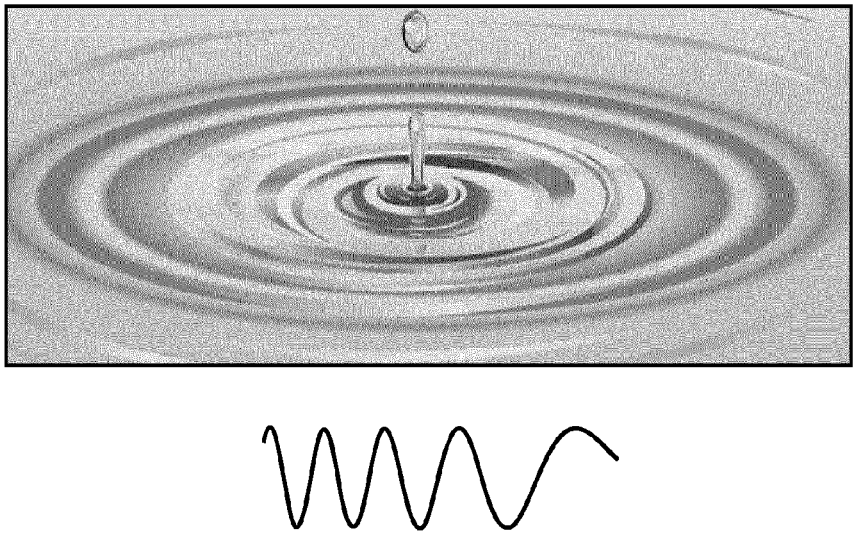
FIG. 3 shows ripples caused by a water droplet.

The luminaire is intended to enable a water wave effect to be created based on lighting. FIG. 3 is an image of a water drop landing on a pool of water. The radially outwardly progressing ripples can be seen. The ripple pattern comprises several loops of ripples, and the wave period increases towards the radial outside. This period change is represented by the simplified graph in FIG. 3 below the image.

Figure 4:
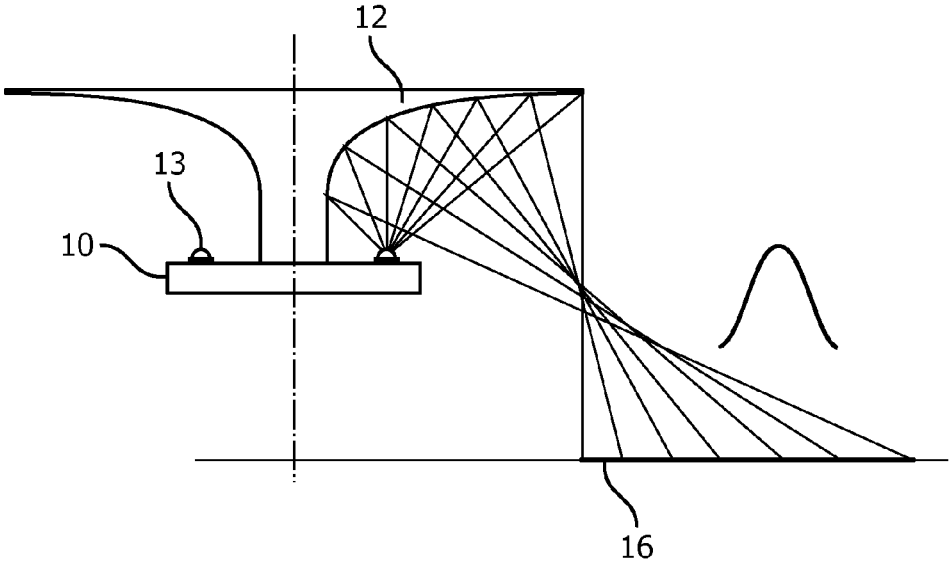
FIG. 4 shows how the reflector forms an annular ring of illumination.

FIG. 4 shows how conservation of flux can be used to design the reflector and the corresponding lighting pattern provided to the target plane, shown as surface 16. FIG. 4 show the shape of the light output from one LED 13 of the array 10 and thus represents a cross section in the vertical plane passing through an LED 13 of one array 10. Flux conservation means that the flux output from the light source is equal to that incident on the target plane. Each LED can be assumed to function as a Lambertian point source so that the light intensity can be expressed as:

$$I(\theta)=I_0 \cos \theta \tag{1}$$

It can be assumed that the light distribution on the target plane 16 is to follow the first half period of a sine curve (as shown schematically in FIG. 4), which means the illuminance on the ground is:

$$E(x)=A \sin (x-a) \tag{2}$$

According to the flux conservation, the following equation results:

$$\int_{\theta_{min}}^{\theta_{max}} I_0 \cos(\theta) d\theta = \int_{r_{min}}^{r_{max}} A \sin(x-a) dx \tag{3}$$

By dividing the target plane into N small parts, based on Equation (3), the profile of the reflector can be obtained. In order to minimize the reflector size, the light directed radially inwardly from the LED 13 is reflected to the radially outer part of the target plane, and the light directed radially outwardly from the LED 13 is reflected to the radially inner part of the target plane.

By arranging multiple LED arrays and associated reflectors, vertically, light patterns can be generated on the target plane which mate to form a larger overall lighting pattern. In order to link adjacent light rings without overlapping, the design and positioning of the reflectors is synchronized. The simplest design option is to use the same design of reflector and adjust only the height to realize the desired combined pattern.

Figure 5:
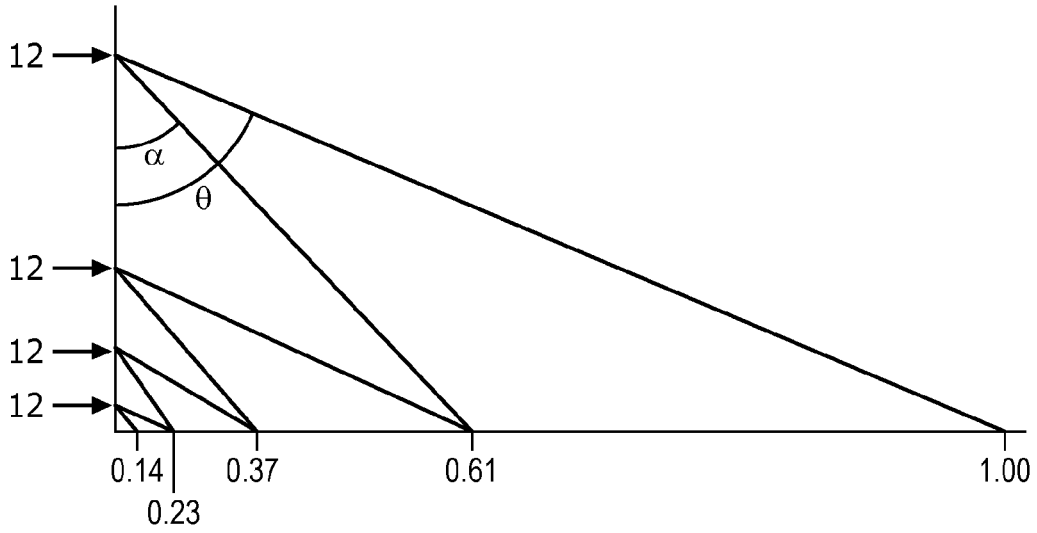
FIG. 5 is used to explain how the position of multiple reflectors can be designed to provide a continuous area of illumination without overlapping from multiple reflectors, and with rings of different radial width.

FIG. 5 shows the light output from four stacked reflectors 12, in which each reflector has the same angular output with a minimum angle to the shaft axis of $\alpha$ and a maximum angle of $\theta$.

Assuming the reflectors are located at height $h_n$ (where n is the reflector number, with n=1 for the bottom reflector up to n=4 for the top reflector in this example), and that the illumination radius on the target surface for reflector number n ranges from $r_{nmin}$ to $r_{nmax}$, the illuminating area of the first reflector can be calculated as:

$$r_{1min}=h_1 \tan \alpha \tag{4}$$

$$r_{1max}=h_1 \tan \theta \tag{5}$$

The height of the second reflector is then given as:

$$h_2 = \frac{r_{1max}}{\tan\alpha} = \frac{h_1 \tan\theta}{\tan\alpha} \tag{6}$$

Similarly, the height of each reflector and the illuminating area can be calculated correspondingly. For example, if the lowest reflector is positioned at a height of 65 mm, and the highest reflector is fixed at a height of 290 mm, with a desired maximum illuminating radius of 1 m, according to the equations (4) to (6), the range of the illuminating radius of the four reflectors are:

0.14 m to 0.23 m;
0.23 m to 0.37 m
0.37 m to 0.61 m
0.61 m to 1.00 m.

The reflectors are at heights 65 mm, 108 mm, 177 mm, 290 mm. These constraints give $\theta$=74 degrees and $\alpha$=65 degrees.

Thus, for a given number of reflectors, a given height of the top reflector (which dictates the overall size of the luminaire) and a given maximum illumination radius, the set of reflector positions can be derived as well as the range of angles to which light is directed by each reflector. Of course, the example above is simply by way of demonstration. In practice it may be desirable to have many more than four reflectors as discussed further below.

The example of FIG. 5 results in each reflector providing an annular illumination pattern with a different radial thickness, which radial thickness increases with radial distance from the lighting system. This matches the ripple effect to be simulated, in that a ripple period increases with increasing distance from the central source as explained above.

Figure 6:
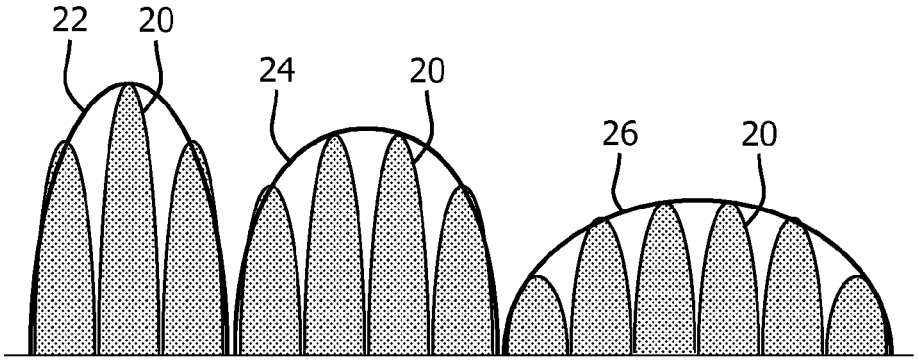
FIG. 6 shows that rings can be formed with constant radial width.

As shown in FIG. 6, the same effect can instead be created by having concentric patterns of the same thickness, but grouping different numbers of rings to form different ripples. In FIG. 6, each illumination ring 20 has the same radial width. Three such rings are grouped to define an inner ripple, four such rings are grouped to define a middle ripple 24 and five rings are grouped to define an outer ripple 26. In this way, control of the lighting is used to give the effect of different width rings. This enables increased flexibility to the lighting effects that can be created. It does however require the reflector designs to be different, since the higher reflectors will require a narrower range of output light directions to create the same radial width on the target surface.

Figure 7:
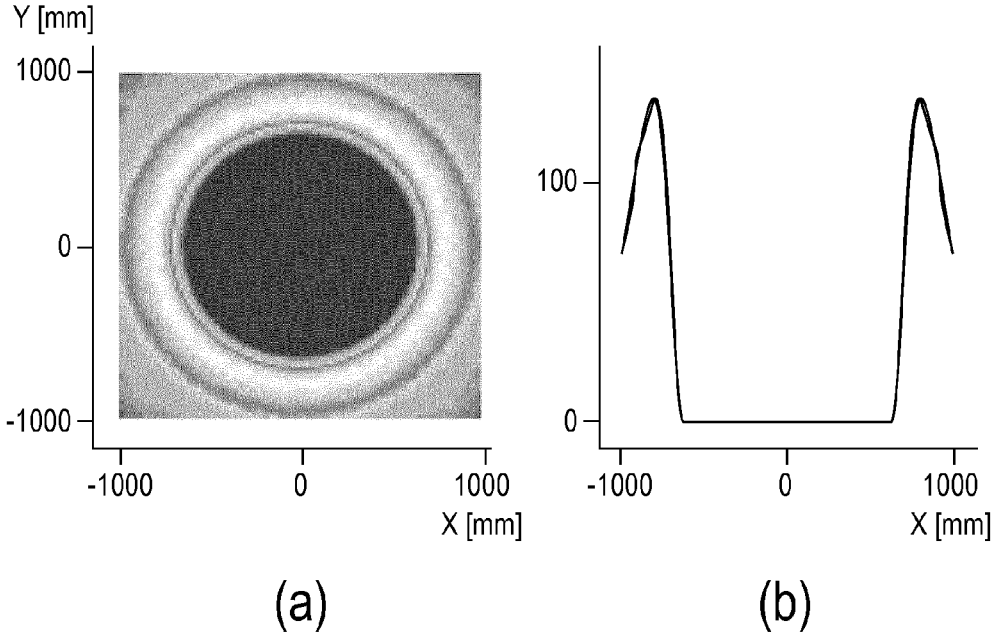
FIG. 7 shows the illumination from one reflector.

FIG. 7 shows a simulation of the light intensity as a function of radius for the highest reflector of the arrangement of FIG. 5, based on a circular array of 20 evenly spaced LEDs. FIG. 7(*a*) shows the light pattern with a brighter greyscale value representing higher intensity, and FIG. 7(*b*) shows the illuminance as a function of radius (assuming a circularly symmetric pattern). Each LED has a lumen output of 27 lumen, and the maximum illuminance on the ground is about 135 lx. It can be observed from the results the light distribution is consistent with the design objective.

Figure 8:
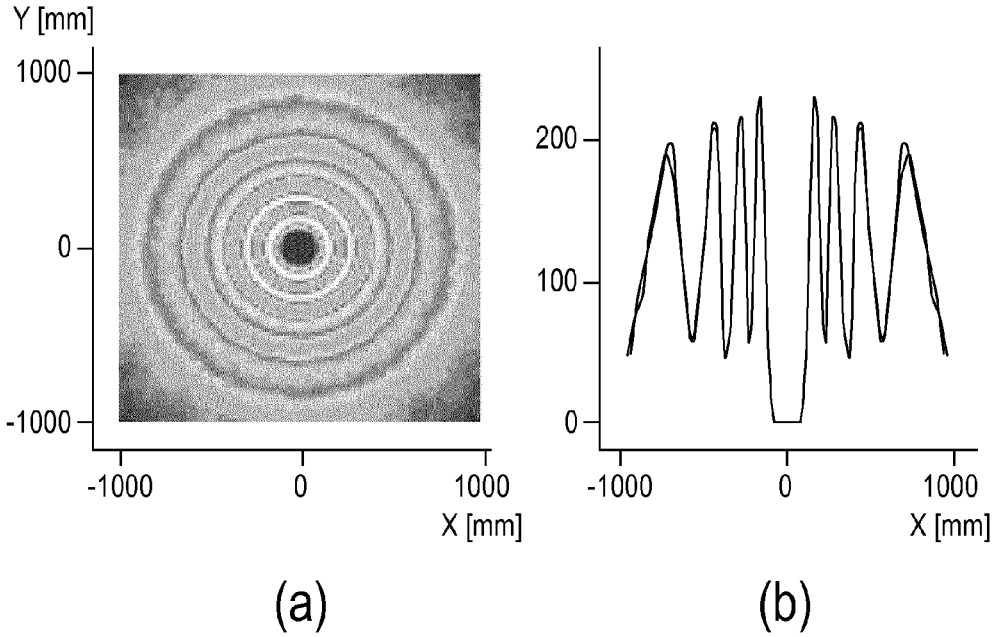
FIG. 8 shows the illumination from a set of four reflectors.

FIG. 8 shows a simulation of the light intensity as a function of radius for all four reflectors of the arrangement of FIG. 5, with each LED array comprising a circular array of 20 evenly spaced LEDs. All LEDs are illuminated in the simulation. FIG. 8(*a*) again shows the light pattern with a brighter greyscale value representing higher intensity, and FIG. 8(*b*) shows the illuminance as a function of radius (assuming a circularly symmetric pattern). The light pattern shows how the outer annular patterns have larger width.

Figure 9:
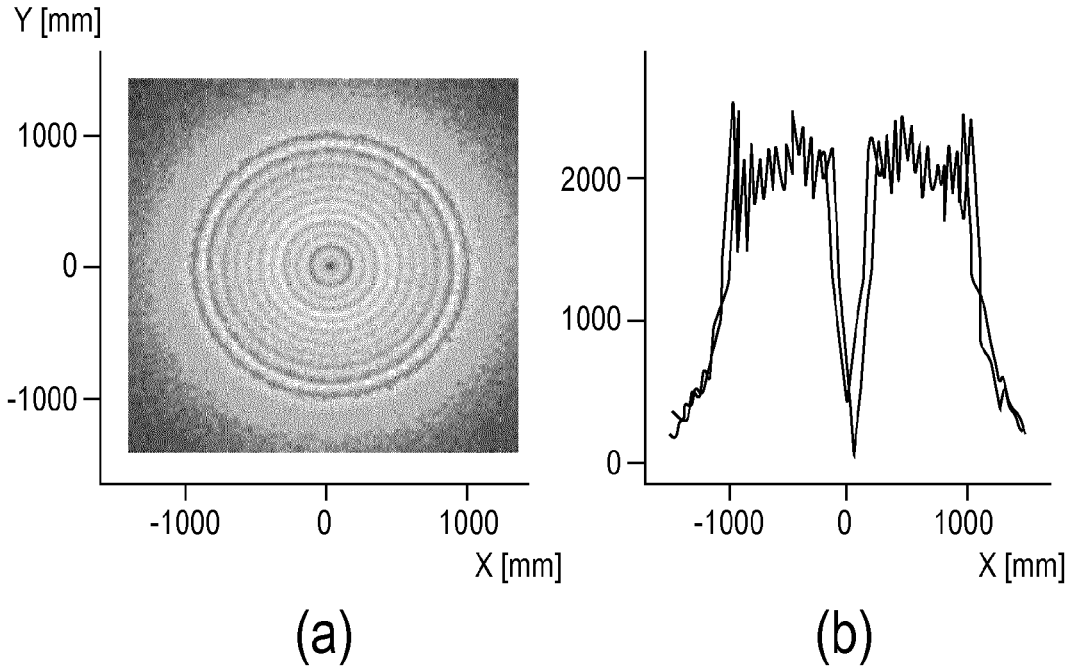
FIG. 9 shows the illumination from a set of ten reflectors.

FIG. 9 shows a simulation of the light intensity as a function of radius for the all reflectors of an arrangement similar to FIG. 6 (with constant radial width of the illumination patterns) but based on a stack of ten LED arrays. All LEDs are illuminated in the simulation. The reflectors have different designs to achieve the constant radial width. Again, FIG. 9(*a*) shows the light pattern with a brighter greyscale value representing higher intensity, and FIG. 9(*b*) shows the illuminance as a function of radius (assuming a circularly symmetric pattern). The light pattern shows how all patterns have the same radial width.

Figure 10:
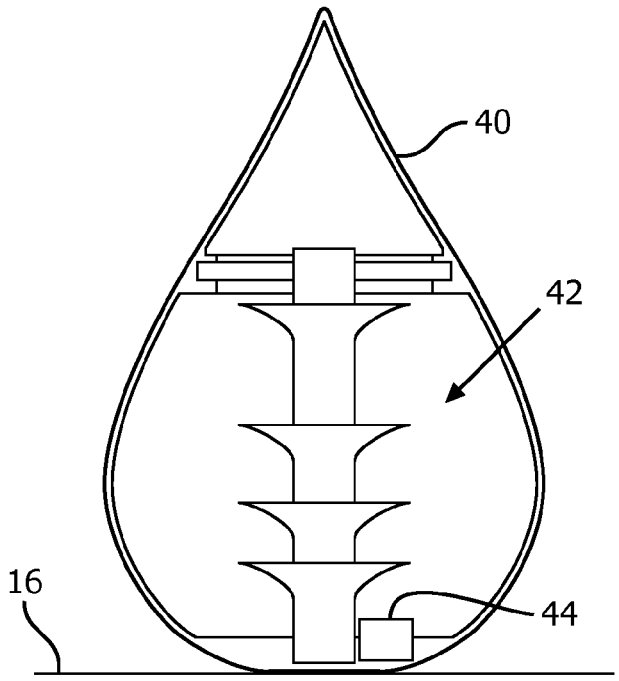
FIG. 10 shows a luminaire with a droplet outer shape.

To make the luminaire more attractive, the appearance of the luminaire can be designed as a droplet shape, such as a water-drop as shown in FIG. 10. The outer shell 40 of the luminaire is formed of a transparent material, such as PMMA. The optics part 42 is inserted into the luminaire, and the lighting patterns are seen at the bottom of the luminaire on the target plane 16. FIG. 10 also shows schematically that the luminaire includes a controller 44 for controlling the lighting effect.

There may be many pre-programmed lighting effects, which the user can select either using a remote controller or by inputting commands to a user interface (not shown). This design allows the luminaire and the lighting effect are blended into one harmonious effect.

Figure 11:
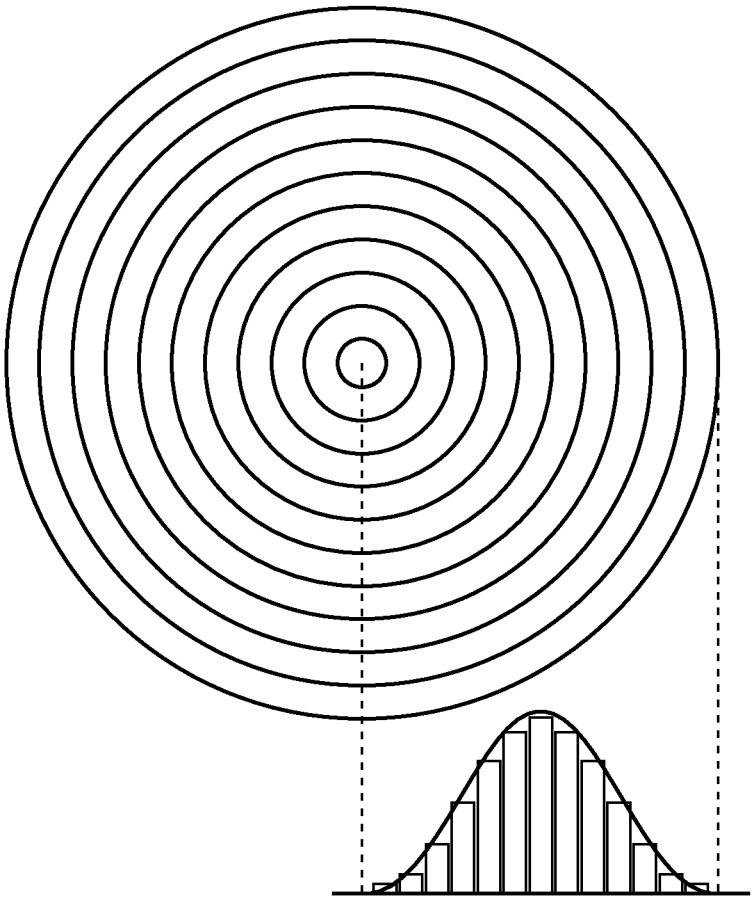
FIG. 11 shows how many narrow illumination rings can be controlled to provide a smooth light function.

FIG. 11 shows a set of ten annular illumination patterns, and shows how the different annular patterns can be controlled to provide a sinusoidal function (shown as a single period of a cosine function), which builds to a peak intensity and drops off. This peak intensity can move radially outwardly to simulate an outwardly propagating wave. The propagation of water waves can be considered as the combination of the effects of a series of simple harmonic vibrations of water molecules. When the water drops down, the water molecules vibrate from inside to outside with different time sequences. By dividing the ripples into several thin annular patterns arranged side by side, the water waves can be simulated more effectively. By using an intelligent control method, many dynamic effects can be realized through superimposing discrete light patterns.

However, the lighting unit is at least capable of providing a ripple effect, by which is meant that a ring of higher intensity moves radially with respect to the lighting system, for example to mimic ripples from a stone dropped into water. However, if desired, an effect of radially inwardly moving ripples can instead be created. For example, a ring may move radially outwardly then back again. Alternatively the ring or rings may move only radially outwardly in a repeating sequence.

To simulate a flowing ripple as accurately as possible the ripples can in this way be divided into multiple thin consecutive rings. Adjacent rings are triggered with a certain period and at a certain moment, so that the ripples exhibit a sinusoidal function in terms of the light intensity change with respect to radial distance. Each ring also follows a sinusoidal function with respect to time.

Figure 12:
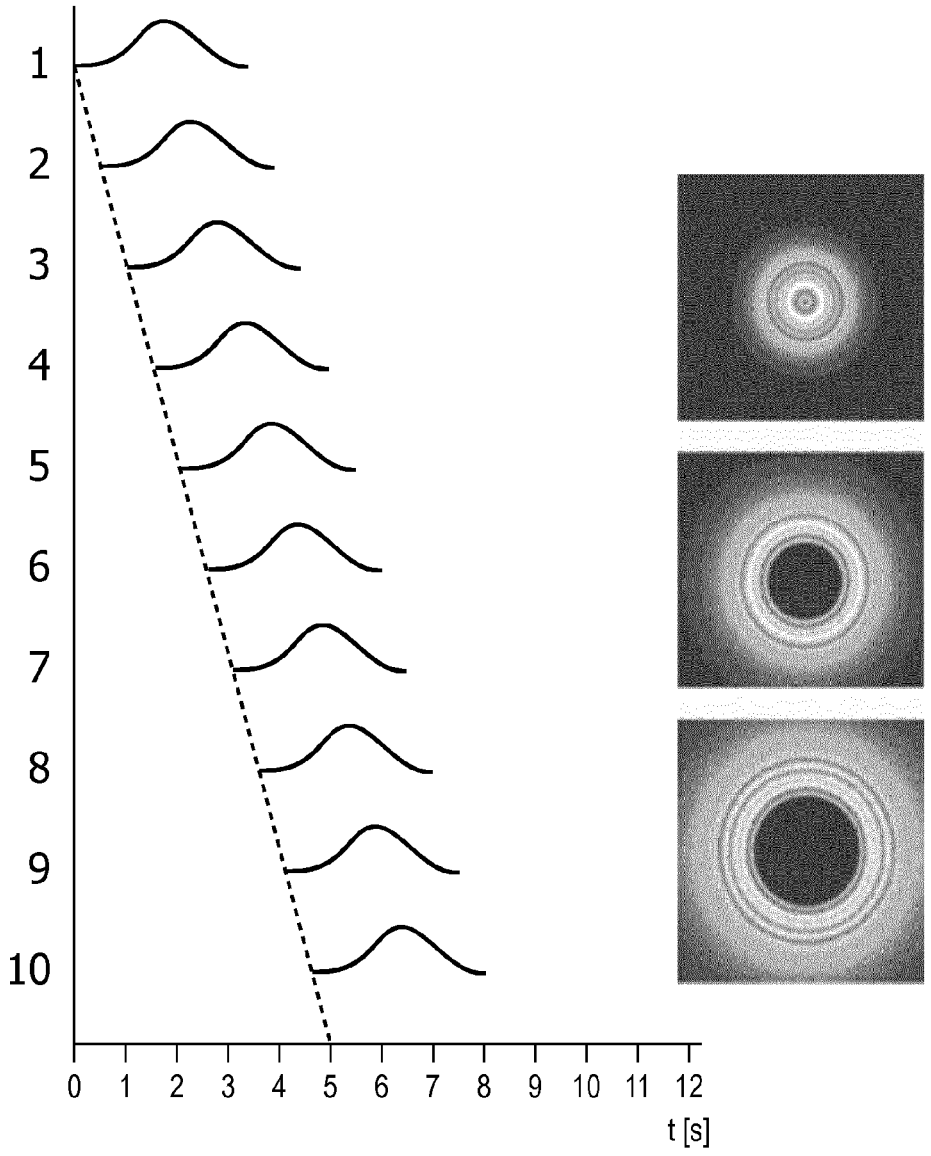
FIG. 12 shows how the multiple rings can be controlled according to a first control method.

FIG. 12 shows one possible control method for an illumination pattern formed of ten annular rings. The relationship between intensity and time for each illumination ring is a sinusoidal function, in particular one period of a cosine function (although a half period of a sine function can also give similar effect).

This means each annular pattern grows in intensity and then decreases to give a more natural lighting effect than an abrupt on-off function. FIG. 12 shows the cosine function for the ten rings (numbered 1 to 10), and shows that the sinusoidal functions can overlap in time, to give the impression of a gradual progression of a ripple radially. The images in FIG. 12 show three different time points.

FIG. 12 shows a single period of a cosine function applied to each light source array, so that a single peak intensity propagates outwardly. However, the sinusoidal function may be continuous, to define a continuous stream of ripples advancing radially (to simulate a vibrating source in water). Instead of a single period or a continuous stream, there may be two or more periods followed by a zero output. This defines two or more ripples passing radially.

The intensity is perceived to travel radially by changing the phase of the sinusoidal intensity functions for successive annular illumination patterns. There may for example be a phase shift in the same sense (i.e. increasing in phase angle or decreasing in phase angle) between the sinusoidal intensity functions for successive adjacent illumination patterns. The phase shift can be a constant amount.

FIG. 12 shows the intensity functions all with the same peak intensity. However, the amplitude of the sinusoidal intensity function for one illumination pattern may also be different to the amplitude of the sinusoidal intensity function for an adjacent illumination pattern. This is shown in FIG. 13.

Figure 13:
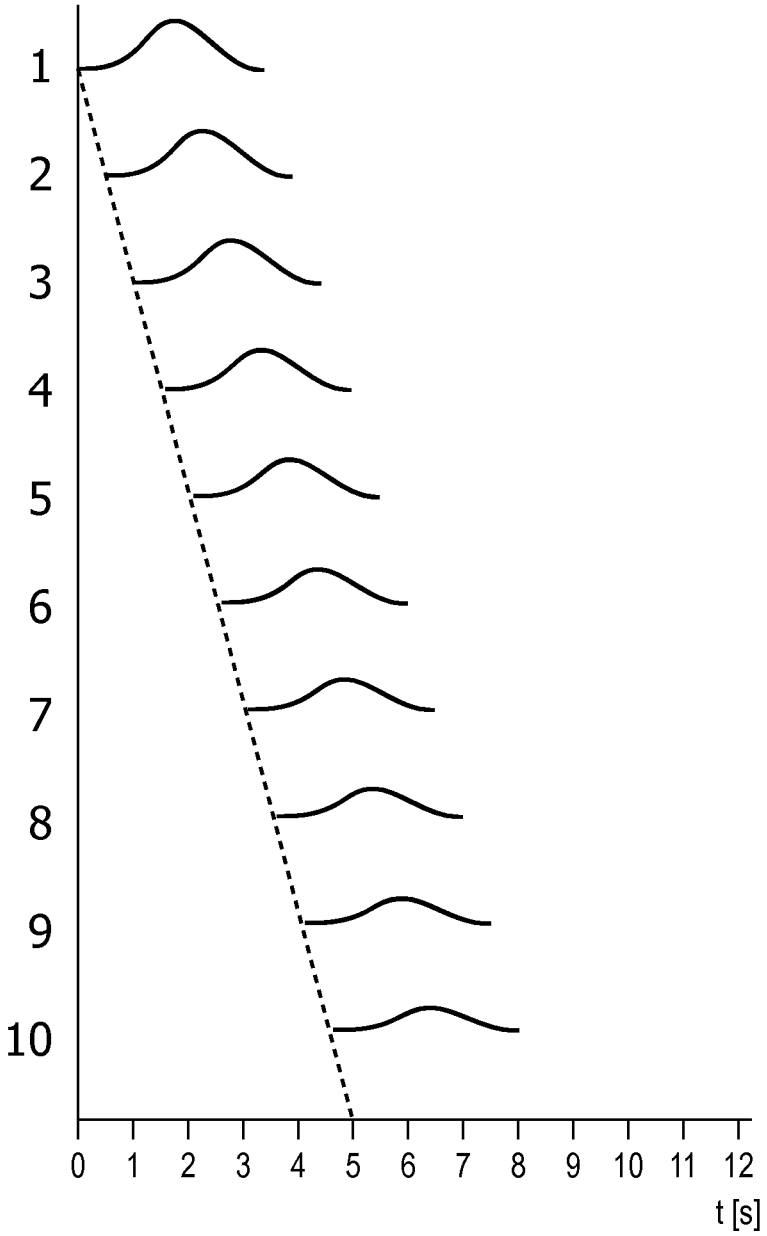
FIG. 13 shows how the multiple rings can be controlled according to a second control method.

The use of different intensities enables a more realistic effect to be obtained, for example with the intensity decreasing with distance as shown in FIG. 13 to mimic ripples fading out with distance.

The graphs in FIG. 12 show the intensity function with respect to time for each ring, and the three images in FIG. 12 show schematically the sinusoidal shape of the intensity profile with respect to radial distance at any particular point in time. This profile shape moves radially over time.

Figure 14:
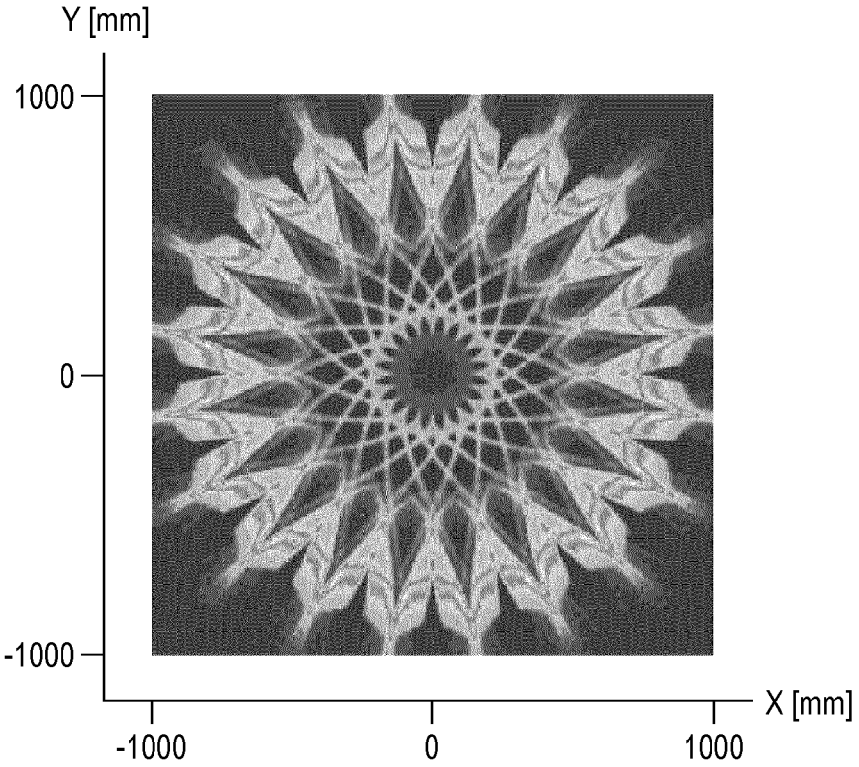
FIG. 14 shows that the rings of illumination do not need to be circular and can be star or flower shaped for example.

The illumination patterns are shown above as circular. FIG. 14 shows an illumination pattern having a star or flower configuration. This can be achieved with a different reflector shape and optionally also non circular placement of the LEDs.

The number of LEDs in each array will be selected based on the desired light output and the individual LED performance. For example there may be many more than 20 LEDs in each array, for example 60 LEDs. When annular illumination patterns of constant width are formed, the width may typically be in the range 5 cm to 30 cm, for example about 10 cm.

The examples above are all based on closed annular illumination patterns. The lighting system may instead be designed to provide only portions of annular patterns, such as 90 degree or 180 degrees portions of an annulus. This is of interest if the lighting system is intended to be placed against a wall, for example, or in a corner.

The lighting system is shown as being designed for mounting on a horizontal surface which is the surface to which illumination is to be provided. This may be a water surface for example of a pond, or a public paved area or a garden space. The lighting system may provide functional lighting or decorative lighting. A larger unit will typically be used outdoors, for example with the dimensions given above, namely a height of 300 mm to 1 m and an illumination pattern radius of 50 cm to 10 m. A smaller version is likely to be desired for indoor use for room decoration or bathroom lighting. Such a unit may have a height less than 50 cm, possible even less than 30 cm, and an illumination pattern radius of less than 50 cm.

The lighting system may instead be designed to be suspended over the surface to be illuminated. In this case, light may also be provided downwardly directly from the base of the lighting system.

The examples above make use of a sinusoidal function to provide a smooth evolution of the lighting effect over time. Other similar functions can of course achieve the same effect, such as a triangular waveform which ramps up and down (optionally with a period of constant illumination intensity at the peak). Numerous other functions with respect to time can be used.

The lighting system is preferably implemented using LEDs. However, this is not essential and other discrete light sources may be used.

The lighting patterns shown above are all based on the LEDs in an array being turned on at the same time. However, additional effects can be obtained by operating the LEDs within an array in a sequence. For example a partial ring can spiral outwardly by combining a radial movement and a rotational movement. Various different lighting effects such as this can be provided as additional options to the basic ripple function.

Furthermore, the examples above assume all LEDs have the same color. For example, all LEDs can have a white light output, or they can be arranged as a set of different color LEDs to create a white output. Instead, different LEDs within each array, or else different arrays can be different colors, or they can all have controllable color output. This can be used to create rainbow type effects. Of course, the greatest flexibility can be achieved by providing each LED with a controllable color output. Different color effects can then be created over time which evolve in the radial direction, or the rotational direction. Of course static light patterns can also be created which change color over time rather than providing a ripple effect.

Figure 15:
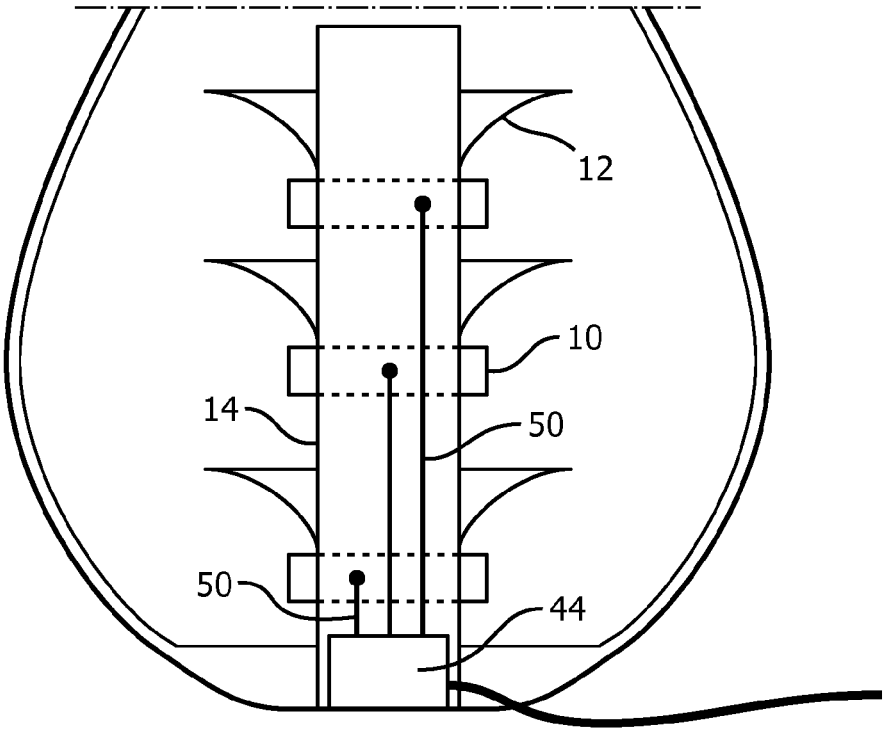
FIG. 15 shows how the lighting controller can be fitted inside the central shaft of the lighting system.

FIG. 10 shows schematically that the system includes a controller 44. FIG. 15 shows that the controller 44 can be fitted inside the central shaft 14, for example at the base. A power coupling to each array of LEDs 10 is shown as 50. Each power coupling may be a shared power line (e.g. a feed and return) for all LEDs of the array, or else separate control lines for each individual LED 13 may be provided if independent LED control is desired. There may be a set of control lines for each array, for example one control line for all red LEDs, one control line for all blue LEDs and one control line for all green LEDs so that the color as well as intensity of the complete array can be controlled. Individual control of each individual LED will instead allow rotational effects to be obtained as well as other color patterns and colors to be controlled. As mentioned above, the controller can have a wireless interface to receive wireless control commands. The lighting unit can be battery operated or mains powered (as shown by the cable in FIG. 15).

Figure 16:
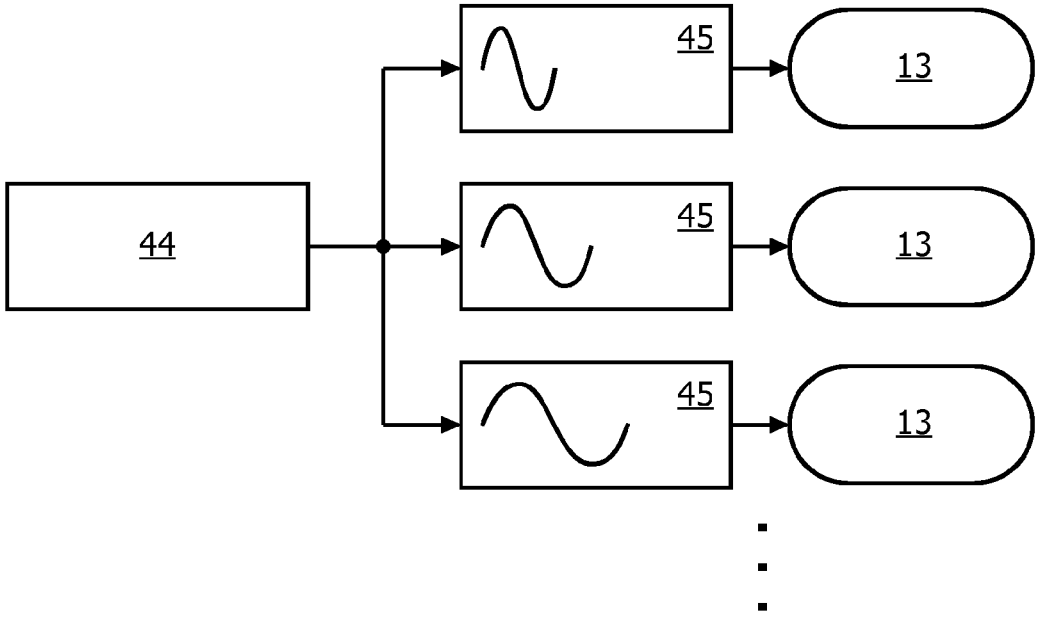
FIG. 16 shows how a single lighting controller can operate respective drivers for each array of light sources.

FIG. 16 shows that the controller provides a dimming output signals to driver modules 45 and each LED array 13 is powered by a respective individual driver module 45. The dimming output signals are provided as a dimming interface which for example can be based on signals controlled by pulse width modulation signal (PWM). The ripple effect is pre-set in the controller 44. Based on the pre-set effect, the controller 44 outputs the dimming signals to the driver modules 45. As explained above, the signal for different driver modules may be different in amplitude and frequency, and a preferred profile comprises a sinusoidal wave. The driver modules 45 preferably have a response time to a received dimming signal from the controller 44 which is smaller than 10 ms, to enable a good ripple animation effect.

The system makes use of a controller to control the lighting effect. The controller can be implemented in numerous ways, with software and/or hardware, to perform the various functions required. A processor is only one example of a controller which employs one or more microprocessors that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions.

Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform at the required functions. Various storage media may be fixed within a processor or controller or may be transportable, such that the one or more programs stored thereon can be loaded into a processor or controller.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting system for providing illumination on a surface, comprising:

a first array of light sources;

a first reflector for reflecting the output of the first array of light sources to form a first annular illumination pattern or a portion of a first annular illumination pattern on the surface;

a second array of light sources;

a second reflector for reflecting the output of the second array of light sources to form a second annular illumination pattern or a portion of a second annular illumination pattern on the surface, arranged concentrically around the first annular illumination pattern or the portion of the first annular illumination pattern; and a controller for controlling the first and second arrays of light sources, wherein the controller is adapted to apply a cyclic function to the light source array outputs thereby to define one or more radially propagating rings or partial rings of illumination on the surface.

2. A lighting system as claimed in claim 1, comprising at least three arrays of light sources and associated reflector, each for forming a different respective concentric annular illumination pattern or portion of an annular illumination pattern.

3. A lighting system as claimed in claim 1, wherein each light source array comprises an annular ring or partial ring of upwardly facing light sources, and each reflector comprises a curved annular or partial annular reflector above the respective light source array, with each light source array extending fully or partially around a shaft at a different position along the shaft.

4. A lighting system as claimed in claim 1, wherein the concentric illumination patterns have different radial thickness, which radial thickness increases with radial distance from the lighting system.

5. A lighting system as claimed in claim 1, wherein each light source array comprises a printed circuit board with LEDs mounted thereon.

6. A lighting system as claimed in claim 1, wherein the controller is adapted to drive each array of light sources with a sinusoidal intensity function.

7. A lighting system as claimed in claim 6, wherein the phase of the sinusoidal intensity function for one annular illumination pattern is different to the phase of the sinusoidal intensity function for an adjacent annular illumination pattern.

8. A lighting system as claimed in claim 7, wherein there is a phase shift in the same sense between the sinusoidal intensity functions for successive adjacent illumination patterns in a direction away from the lighting system.

9. A lighting system as claimed in claim 6, wherein the amplitude of the sinusoidal intensity function for one illumination pattern is different to the amplitude of the sinusoidal intensity function for an adjacent illumination pattern.

10. A method of providing lighting using a lighting system for providing illumination on a surface, which comprises a first array of light sources forming a first annular illumination pattern or a portion of a first annular illumination pattern on the surface and a second array of light sources forming a second annular illumination pattern or a portion of a second annular illumination pattern on the surface arranged concentrically around the first annular illumination pattern, the method comprising:

applying a cyclic function to the light source outputs thereby to define one or more radially propagating rings or partial rings of illumination.

11. A method as claimed in claim 10, comprising:

driving each array of light sources with a sinusoidal intensity function, wherein the phase of the sinusoidal intensity function for one illumination pattern is different to the phase of the sinusoidal intensity function for an adjacent illumination pattern.

12. A method as claimed in claim 11, comprising:

driving each array of light sources such that there is a phase shift in the same sense between the sinusoidal intensity functions for successive adjacent illumination patterns in a direction away from the lighting system.

13. A method as claimed in claim 10, comprising:

driving each array of light sources with a sinusoidal intensity function, wherein the amplitude of the sinusoidal intensity function for one illumination pattern is different to the amplitude of the sinusoidal intensity function for an adjacent illumination pattern such that there is a decrease in amplitude between the sinusoidal intensity functions for successive adjacent illumination patterns in a direction away from the lighting system.

14. A computer program product downloadable from a communication network and/or stored on a computer-readable and/or microprocessor-executable medium comprising code which is adapted to perform the method of claim 10 when said program is run on a computer.

15. A medium for storing and comprising the computer program product as defined in claim 14.

* * * * *